US005444914A

United States Patent [19]

Dekker et al.

[11] Patent Number: 5,444,914

[45] Date of Patent: Aug. 29, 1995

[54] SHAVING APPARATUS

[75] Inventors: Jacobus N. Dekker; Dirk Wevers, both of Drachten, Netherlands

[73] Assignee: U.S. Philips Corporation, New York, N.Y.

[21] Appl. No.: 152,766

[22] Filed: Nov. 15, 1993

[30] Foreign Application Priority Data

Nov. 23, 1992 [EP] European Pat. Off. ..... 92203607

[51] Int. Cl.[6] ..... B26B 19/04

[52] U.S. Cl. ..... 30/43.6; 30/43.9; 30/346.51

[58] Field of Search ..... 30/43.5, 43.6, 43.9, 30/346.51, 347, 265, 43.4

[56] References Cited

U.S. PATENT DOCUMENTS

| | | | |
|---|---|---|---|
| 2,184,180 | 12/1939 | Fairey | 30/43.6 |
| 2,238,278 | 4/1941 | Moskovics et al. | 30/347 |
| 3,927,581 | 12/1975 | Kolodziej | 30/346.51 |
| 4,589,205 | 5/1986 | Tanahashi | 30/346.51 |
| 4,729,169 | 3/1988 | Asawa | 30/43.6 |
| 4,882,840 | 11/1989 | Tietjens | 30/43.6 |
| 5,031,315 | 7/1991 | Labrijn | 30/41 |
| 5,119,558 | 6/1992 | van Erp et al. | 30/43.6 |

FOREIGN PATENT DOCUMENTS 1816867 7/1970 Germany .

*Primary Examiner*—Richard K. Seidel
*Assistant Examiner*—Allan M. Schrock
*Attorney, Agent, or Firm*—Ernestine C. Bartlett

[57] ABSTRACT

A shaving apparatus has at least one shaving unit (2) which comprises an external shaving member (3) and an internal shaving member (4) which is rotatable relative to the external shaving member, the external shaving member having an annular wall portion (5) with lamellae (7) which extend in substantially radial directions and between which hair-entry apertures (8) are formed, the internal shaving member comprising cutters (10) which describe a path adjoining the inner side (12) of the annular wall portion (5) of the external shaving member (4). In order to obtain a closer shave without an increased risk of injury to the skin the shaving apparatus is characterized in that the cutters (10) together form one undulating continuous ring-shaped cutter body covering all the hair-entry apertures (8).

2 Claims, 2 Drawing Sheets

SHAVING APPARATUS

BACKGROUND OF THE INVENTION

The invention relates to a shaving apparatus having at least one shaving unit comprising an external shaving member and an internal shaving member which is rotatable relative to the external shaving member, the external shaving member having an annular wall portion with lamellae which extend in substantially radial directions and between which hair-entry apertures are formed, the internal shaving member comprising cutters having cutting edges which describe a path adjoining the inner side of the annular wall portion of the external shaving member.

Such a shaving apparatus is known from U.S. Pat. No. 5,031,315 (PHN 12794).

In this known shaving apparatus the part of each cutter which is in contact with the inner side of the annular wall portion of the external shaving member is generally of rectangular cross-section, the large rectangle sides being directed substantially radially. The foremost vertices of the rectangle, viewed in the direction of rotation, are more likely to cause injury to the skin protruding from a hair-entry aperture than the central portion of the cutter. For this reason the thickness of the lamella should be larger at the location of the ends of the cutter than at the location of the centre of the cutter. This leads to a shave which is less close than desired.

SUMMARY OF THE INVENTION

It is an object of the invention to improve the shaving apparatus in such a manner that a close shave is obtained within a shorter time and without the risk of injury to the skin being increased.

For this purpose the shaving apparatus in accordance with the invention is characterized in that the cutters together form a ring-shaped cutter body having a rim which adjoins the inner side of the annular wall portion of the external shaving member thereby covering all the hair-entry apertures, which rim is undulated in the plane containing the inner side of the annular wall portion of the external shaving member and is provided with cutting edges. An advantage of the shaving apparatus in accordance with the invention is that the cutters no longer have vertices which can injure the skin, so that the thickness of the lamellae near the radial ends of the cutters can be reduced, which yields a closer shave. An additional advantage is that the likelihood of lamella breakage is reduced.

It is to be noted that DE-A-1816867 discloses a shaving apparatus having undulating and ring-shaped cutters. However, the external shaving member of this known apparatus is formed by a cylindrical semicircular foil, whereas the internal shaving member is a shaving cylinder comprising a plurality of cutter discs which extend perpendicularly to the axis of rotation of the shaving cylinder and whose undulating cutters are curved in conformity with the cylindrical semicircular foil.

A preferred embodiment of the shaving apparatus is characterized in that the cutters extend substantially perpendicularly to the path of the cutting edges. It has been found that the angle of the cutters relative to the path of the cutting edges influences the degree of skin irritation. An acute angle between the cutter and the external shaving member is more likely to lead to skin injury than a right angle, while it has been found that a right angle yet provides a satisfactory shaving performance. It is now even possible to reduce the lamella thickness.

The invention will now be described in more detail on the basis of an exemplary embodiment shown in the drawings. In the drawings:

DETAILED DESCRIPTION OF THE INVENTION

Figure 1:
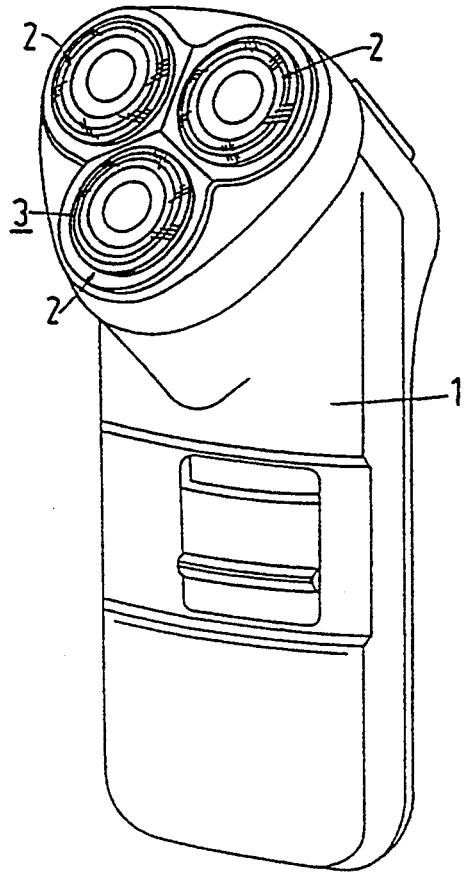
FIG. 1 is a perspective view of a shaving apparatus comprising three shaving units.
Figure 2:
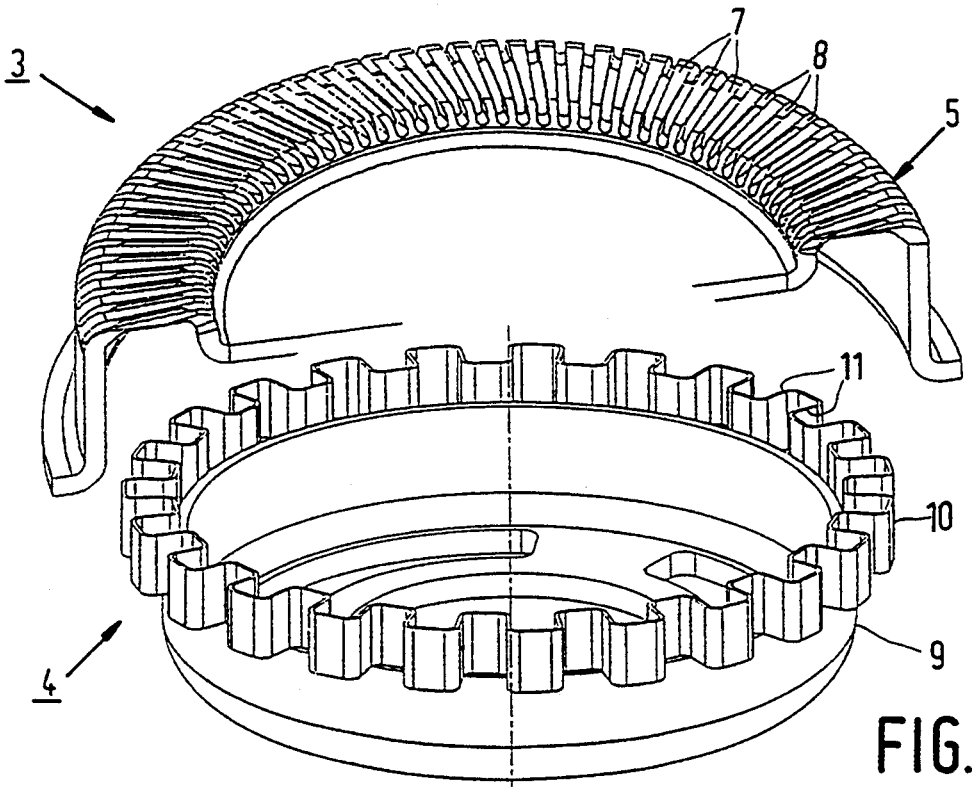
FIG. 2 is an enlarged-scale perspective view of an external shaving member and an internal shaving member used in the shaving unit shown in FIG. 1.

The shaving apparatus comprises a housing 1 with three shaving units 2. A shaving unit 2 comprises an external shaving member 3 and an internal shaving member 4, which is rotatable relative to the external shaving member. In known manner the internal shaving member can be driven by means of an electric motor, not shown, which is accommodated in the housing.

Figure 3:
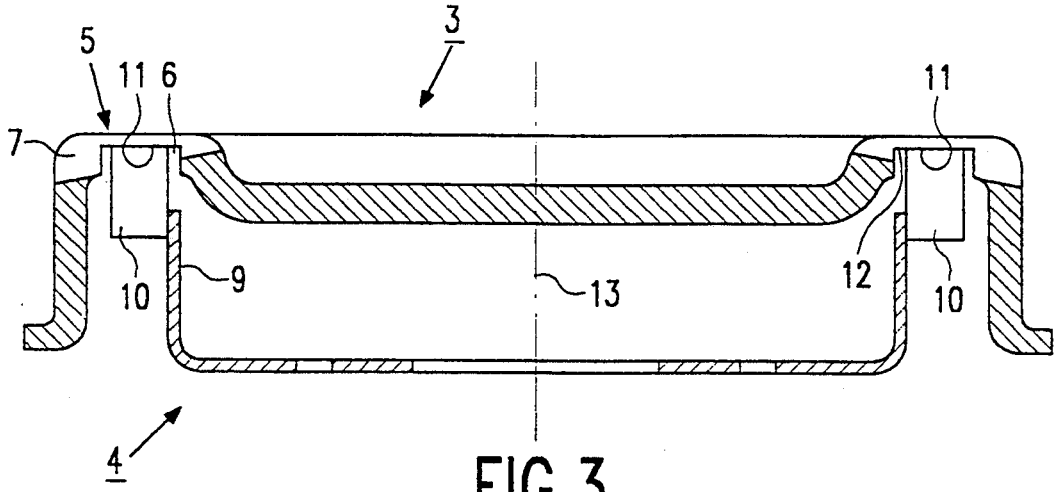
FIG. 3 is a cross-sectional view of a shaving unit shown in FIG. 1.

The external shaving member 3 has a substantially annular wall portion 5. The inner side of the external shaving member has an annular groove 6 (see FIG. 3) at the location of the wall portion 5. The wall portion 5 is constituted by lamellae 7 which extend in substantially radial directions and between which hair-entry apertures 8 are formed. The internal shaving member 4 comprises a support 9 carrying a rim 10 adjoining the bottom 12 of the groove 6. The rim comprises a cylindrical wall having a continuous undulating shape corresponding to a circle and undulated in the plane containing the bottom 12 of the groove 6 of formed by the lamellae 7 of the external shaving member 3. At its edge, adjoining the groove 6, the rim 10 has a large number of cutting edges 11 which together also have a continuous undulating shape undulated in the plane containing the bottom 12 of the groove 6 and adjoin the bottom 12 of the groove 6.

Figure 4:
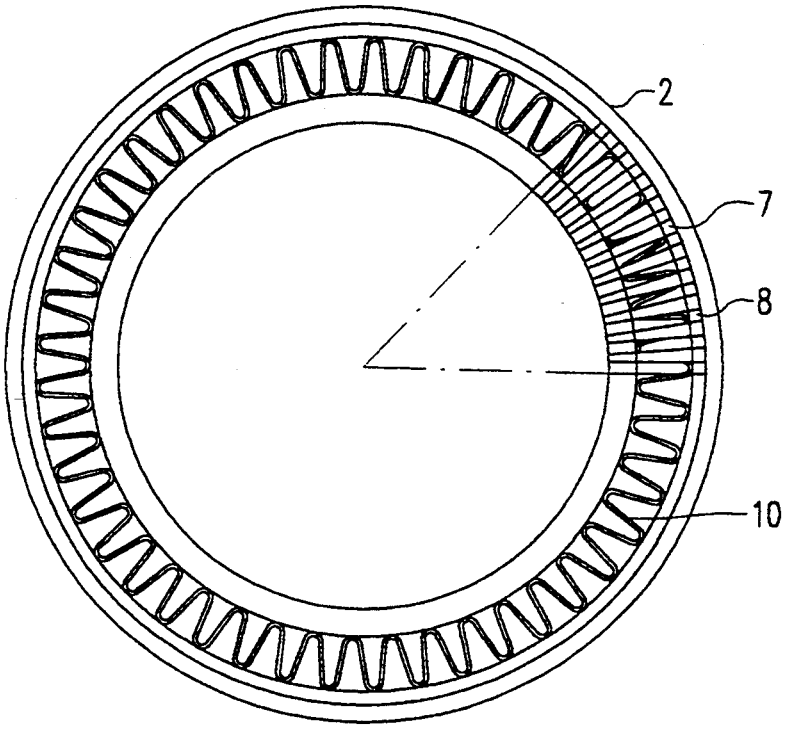
FIG. 4 shows diagrammatically a shaving unit whose cutter has a slightly different undulation.

FIG. 4 shows diagrammatically a shaving unit 2 whose rim 10 has a slightly different undulating shape. This rim has 90 undulations and, consequently, 90 cutting edges 11.

We claim:

1. A shaving apparatus having at least one shaving unit comprising an external shaving member and an internal shaving member which is rotatable relative to the external shaving member, the external shaving member having an annular wall portion with inner and outer sides and with lamellae which extend in substantially radial directions and between which hair entry apertures are formed, the internal shaving member comprising a ring-shaped cutter body having a rim adjoining the inner side of the annular wall portion of the external shaving member, said rim being undulated continuously in a plane containing said inner side of the annular wall portion and being provided with cutting edges.

2. A shaving apparatus as claimed in claim 1 wherein the rim extends substantially perpendicularly to the inner side of the annular wall portion of the external shaving member.

* * * * *